US009994068B1

(12) United States Patent
Kassan et al.

(10) Patent No.: US 9,994,068 B1
(45) Date of Patent: Jun. 12, 2018

(54) ARTIST'S PALETTE

(71) Applicants: David Kassan, Brooklyn, NY (US); David Lemyre, Southampton, NJ (US)

(72) Inventors: David Kassan, Brooklyn, NY (US); David Lemyre, Southampton, NJ (US)

( * ) Notice: Subject to any disclaimer, the term of this patent is extended or adjusted under 35 U.S.C. 154(b) by 12 days.

(21) Appl. No.: 15/381,956

(22) Filed: Dec. 16, 2016

Related U.S. Application Data

(60) Provisional application No. 62/268,210, filed on Dec. 16, 2015.

(51) Int. Cl.

| | |
|---|---|
| ***B44D 3/00*** | (2006.01) |
| ***B44D 3/02*** | (2006.01) |
| ***B44D 3/04*** | (2006.01) |
| ***B44D 3/12*** | (2006.01) |
| ***B65D 25/54*** | (2006.01) |
| ***B65D 43/02*** | (2006.01) |
| ***B65D 25/24*** | (2006.01) |

(52) U.S. Cl.
CPC ..... *B44D 3/02* (2013.01); *B44D 3/04* (2013.01); *B44D 3/12* (2013.01); *B65D 25/24* (2013.01); *B65D 25/54* (2013.01); *B65D 43/02* (2013.01)

(58) Field of Classification Search
CPC ... B44D 3/02; B44D 3/12; B44D 3/04; B44D 3/06; B65D 25/54; B65D 25/24
USPC .... 206/1.7, 1.8, 1.9, 81, 214, 575, 557, 561, 206/564, 818
See application file for complete search history.

(56) References Cited

U.S. PATENT DOCUMENTS

| | | | | | |
|---|---|---|---|---|---|
| 1,560,837 | A | | 11/1925 | Mastrukoff | |
| 2,711,605 | A | | 6/1955 | Dripps | |
| 2,940,200 | A | * | 6/1960 | Endlich | B44D 3/04 206/1.7 |
| 3,273,700 | A | * | 9/1966 | Moreau | B44D 3/04 206/1.7 |
| 3,352,616 | A | * | 11/1967 | Linger | B44D 3/02 206/1.7 |
| 3,428,167 | A | | 2/1969 | Sheng | |
| 3,429,450 | A | | 2/1969 | Lambert | |
| 3,650,589 | A | * | 3/1972 | Linger | B44D 3/04 206/1.7 |
| 3,776,371 | A | | 12/1973 | Linger | |
| 3,945,490 | A | * | 3/1976 | Thompson | B44D 3/02 206/1.7 |
| 4,061,224 | A | * | 12/1977 | Fuhri | B44D 3/04 206/1.7 |
| 4,149,628 | A | * | 4/1979 | Gabarro | B44D 3/04 206/107 |

(Continued)

*Primary Examiner* — Jacob K Ackun
*Assistant Examiner* — Jenine Pagan
(74) *Attorney, Agent, or Firm* — Budzyn IP Law, LLC

(57) ABSTRACT

An artist's palette is provided herein including: a body having a first, generally flat surface; a protruding first ridge running along an edge of the first surface; and, a pane removably mountable to the body, the pane being transparent or sufficiently translucent to permit visual color matching through the pane of a sample of prepared paint disposed on the pane with a reference sample disposed between the pane and the body. The artist's palette may be provided as part of an assembly which also includes a cover removably mountable to the body, the cover being configured to be mounted to the body without any portion of the cover contacting the first surface and without any portion of the cover contacting the pane.

18 Claims, 3 Drawing Sheets

(56) References Cited

U.S. PATENT DOCUMENTS

| | | | | | |
|---|---|---|---|---|---|
| 4,699,346 | A * | 10/1987 | Bahm | A47B 97/04 | 108/90 |
| 4,703,910 | A | 11/1987 | Ross | | |
| 4,740,014 | A | 4/1988 | Holt | | |
| 4,756,405 | A * | 7/1988 | Crozier | B44D 3/123 | 206/1.7 |
| 4,911,642 | A | 3/1990 | Knowles | | |
| 4,995,515 | A | 2/1991 | Smith | | |
| 5,135,012 | A * | 8/1992 | Kamen | A45C 13/02 | 132/294 |
| 5,257,721 | A * | 11/1993 | Smith | B44D 3/04 | 206/1.7 |
| 5,484,637 | A | 1/1996 | Paragon et al. | | |
| 5,850,910 | A | 12/1998 | Broyles et al. | | |
| 7,188,818 | B2 | 3/2007 | Chang | | |
| 7,377,476 | B2 | 5/2008 | Almond et al. | | |
| 7,694,806 | B2 * | 4/2010 | Huggins | B44D 3/02 | 206/1.7 |
| 8,584,872 | B2 | 11/2013 | Eiseman | | |
| 2005/0061709 | A1 * | 3/2005 | Sieling | B44D 3/02 | 206/575 |

* cited by examiner

FIG. 1
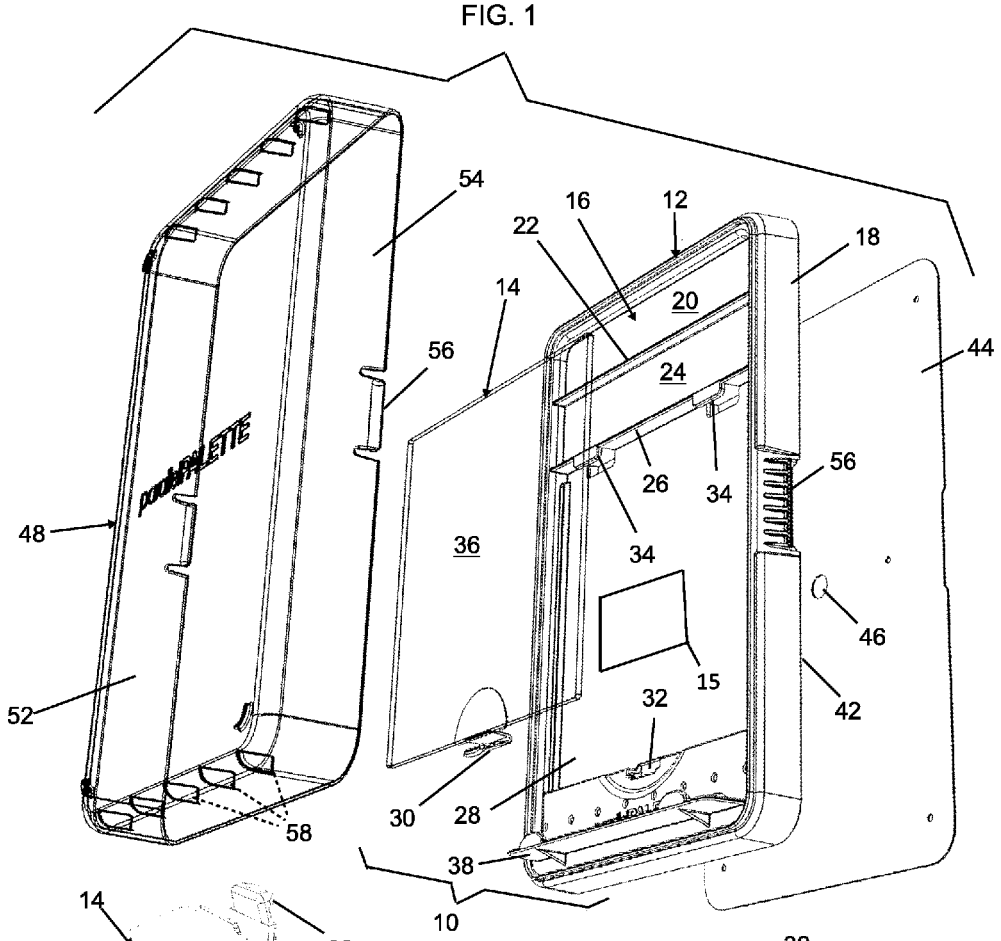
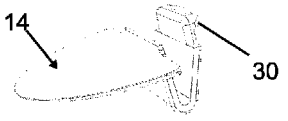
FIG. 2
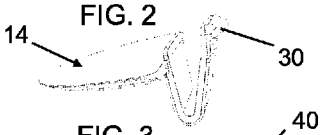
FIG. 3
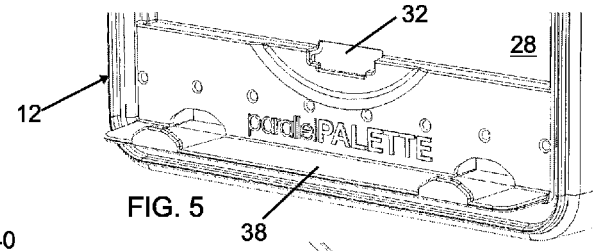
FIG. 5
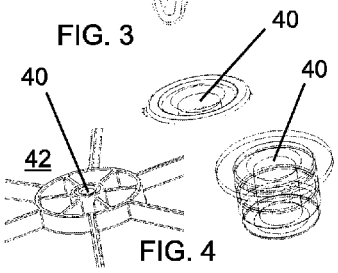
FIG. 4
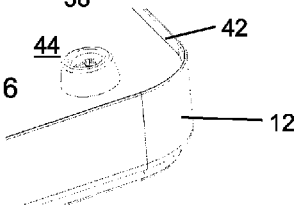
FIG. 6

ARTIST'S PALETTE

CROSS-REFERENCE TO RELATED APPLICATION

This application claims priority to U.S. Provisional Patent Application No. 62/268,210, filed Dec. 16, 2015, the contents which are incorporated by reference herein.

BACKGROUND OF THE INVENTION

Hand-held artist's palettes are well known in the prior art for supporting a plurality of different paints and for providing an area for mixing paints. In addition "hands-free" artist's palettes have been developed in the prior art where a palette may be supported by a free-standing structure, such as shown in U.S. Pat. No. 4,703,910 and U.S. Pat. No. 7,377,476.

SUMMARY OF THE INVENTION

An artist's palette is provided herein including: a body having a first, generally flat surface; a protruding first ridge running along an edge of the first surface; and, a pane removably mountable to the body, the pane being transparent or sufficiently translucent to permit visual color matching through the pane of a sample of prepared paint disposed on the pane with a reference sample disposed between the pane and the body. The artist's palette may be provided as part of an assembly which also includes a cover removably mountable to the body, the cover being configured to be mounted to the body without any portion of the cover contacting the first surface and without any portion of the cover contacting the pane.

These and other features of the invention will be better understood through a study of the following detailed description and accompanying drawings.

BRIEF DESCRIPTION OF THE DRAWINGS

FIGS. 1-8 depict an artist's palette, including as part of an assembly, and portions thereof, in accordance with the subject invention.

DETAILED DESCRIPTION

Figure 7:
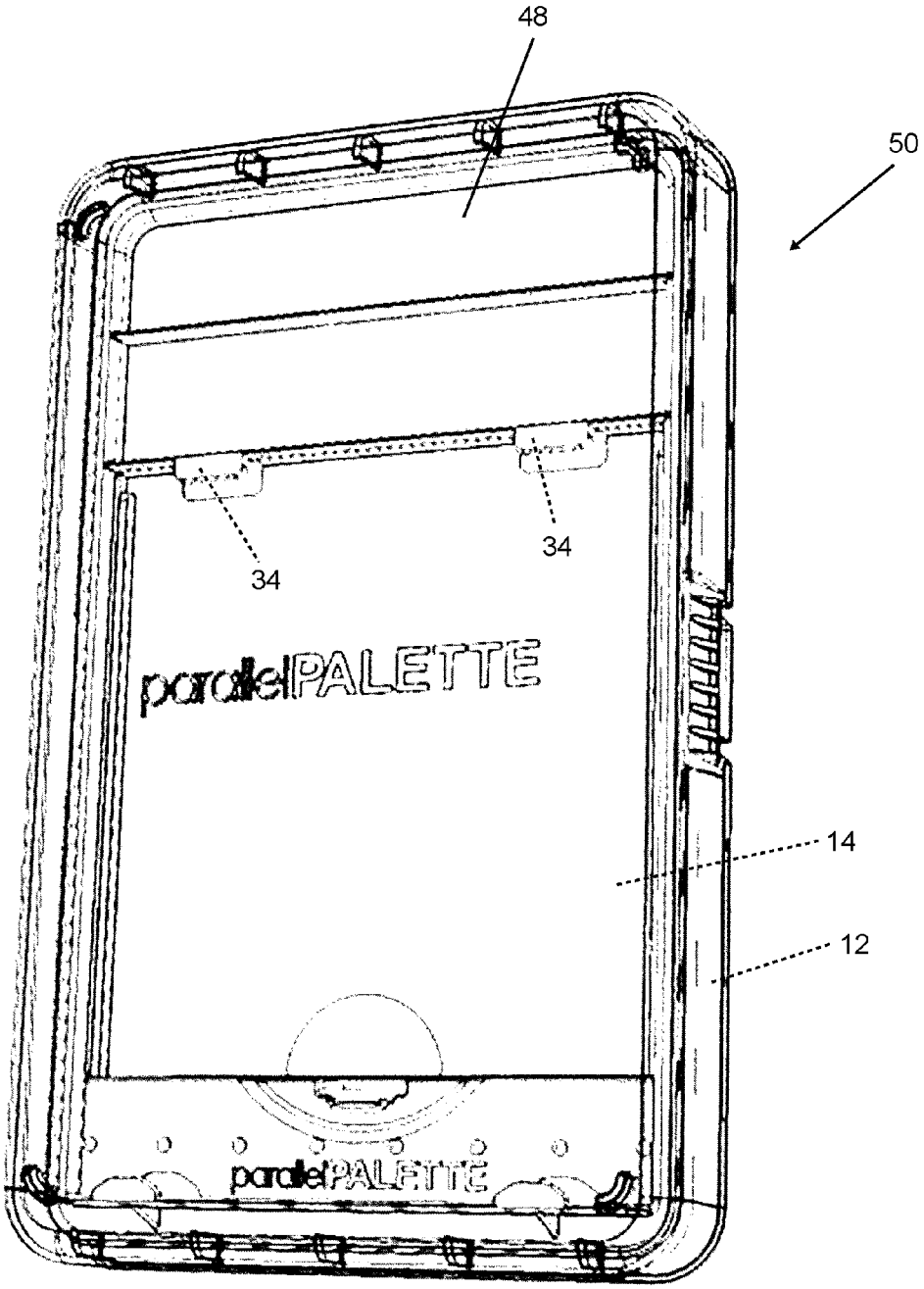
Figure 8:
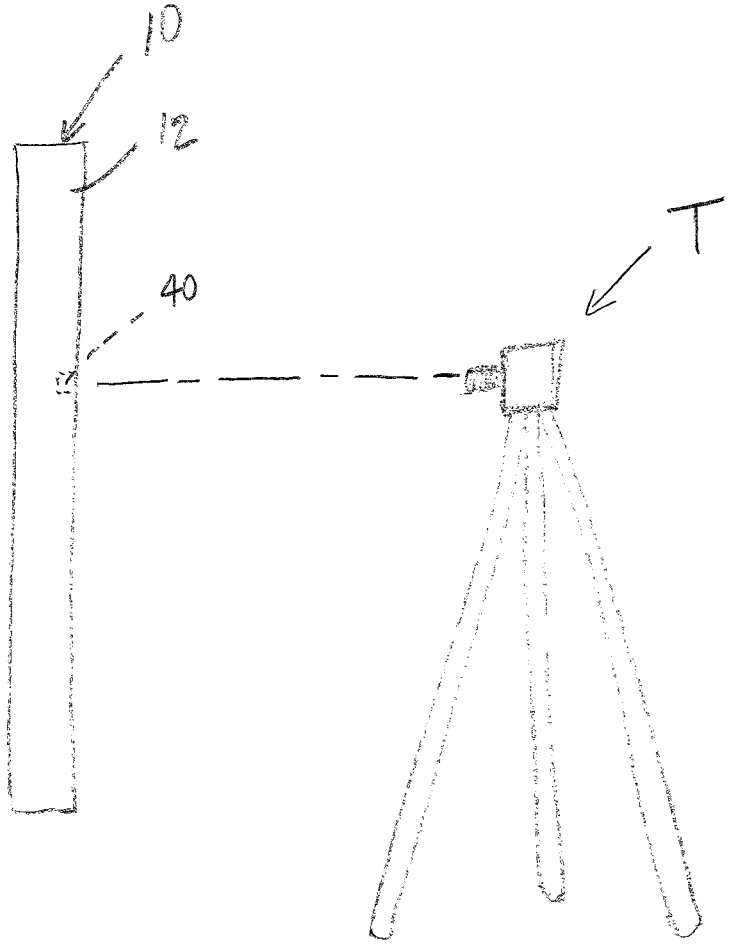

With reference to FIG. 1, an artist's palette 10 is shown which generally includes a body 12 and a pane 14 configured to be removably mountable to the body 12.

The body 12 may include an upper tray portion 16 bounded by an edge 18. Collectively, the tray portion 16 and the edge 18 may provide the body 12 with a box shape. The body 12 may be formed of various materials including being unitarily formed, e.g., as molded thermoplastic, or modularly formed using various block components. One or more portions of the body 12 may be formed of a thermoplastic, metallic and/or glass material.

A generally flat first surface 20 is provided with the body 12, particularly on the tray portion 16. A protruding first ridge 22 runs along an edge of the first surface 20. The first surface 20 is sized sufficiently to support a plurality of globs of paint. A second, generally flat surface 24 may be provided which extends from the first ridge 22, also configured to support a plurality of globs of paint. A protruding second ridge 26 may run along an edge of the second surface 26. The first and second ridges 22, 26 may be considered topographical features which delineate paint storage regions.

As shown in the Figures, the first and second surfaces 20, 24 may be generally coplanar. In addition, the first and second ridges 22, 26 may be generally parallel.

The pane 14, when mounted to the body 12, provides a mixing or thinning area for an artist to combine or thin a plurality of paints. The pane 14 is removable from the body 12 to allow for efficient cleaning. In addition, it is preferred that a recess 28 be defined in the body 12 to be located behind the pane 14 when mounted to the body 12 to receive a swatch, photograph or other visual representation of one or more colors for an artist. The pane 14 is preferably transparent or sufficiently translucent to allow for visual color matching between paints disposed on the pane 14 and a reference sample 15 disposed between the pane 14 and the body 12, including within the recess 28.

As will be appreciated by those skilled in that art, various arrangements for permitting removable mounting of the pane 14 to the body 12 may be utilized with the subject invention. By way of non-limiting example, one or more resilient locking members 30, such as snap-lock locking members, may be provided on the pane 14 formed to engage with corresponding apertures 32 in the body 12. One or more protrusions 34 may be also provided on the body 12 for engaging one or more edges of the pane 14. In this manner, portions of the pane 14 may be engaged by, e.g., being inserted below, the protrusions 34 to be maintained thereby. To allow for uniform exposure of light, outwardly directed face 36 of the pane 14 may be located to be generally coplanar with the first surface 20 and/or the second surface 24 with the pane 14 being mounted to the body 12.

Preferably, the pane 14 is formed of a thermoplastic material, such as an acrylic. Alternatively, the pane 14 may be formed in whole or in part of glass, wood, paper (e.g., paper board), and/or metal. One or more potions of the pane 14 may be opaque, such as being provided with an opaque frame about a transparent/translucent inner portion. The locking members 30 may be provided as separate components, for example made of a thermoplastic material, and mounted to the pane 14.

At least one shelf of 38 may be provided to extend outwardly from the body 12 configured to support at least one paint brush in a horizontal position. The shelf 38 may be hinged to the body 12 and/or be formed to be slidable relative to the body 12 to be stowed as necessary.

To allow for "hands free" use of the artist's palette 10, one or more threaded apertures 40 may be defined in the body 12 to permit mounting to a free-standing support, such as a standard camera tripod T. Preferably, the threaded aperture 40 is located in a back portion 42 of the body 12, opposite the tray portion 16. The threaded aperture 40 may be formed in accordance with ISO 1222:2010, which defines a standard for camera tripod mounting including specifics for standard threaded mounting apertures. Under this standard, a threaded aperture of ¼-20 UNC or ⅜-16 UNC may be utilized. The larger ⅜-16 UNC size may be utilized with a removable adapter that also allows for the smaller ¼-20 UNC size mounting as well. Optionally, a back cover 44 may be provided to cover the back portion 42. An opening 46 is provided in the back cover 44 corresponding to each of the threaded apertures 40 to provide access thereto.

The artist's palette 10 may be mounted in a vertical or generally vertical orientation. Thus, the first ridge 22 may be located gravitationally below the first surface 20 and the second ridge 26 may be located gravitationally below the second surface 24. Preferably, the threaded aperture 40 is disposed to permit mounting to achieve vertical or generally vertical mounting on a standard camera tripod T or other free-standing structure.

A cover 48 may be provided with the artist's palette 10 to form an assembly 50. The cover 48 is formed to be removably mountable to the body 12. The cover 48 may include a top 52 and skirt 54. The skirt 54 may be formed to telescope over the body 12. One or more features 56, particularly on the skirt 54 and/or the body 12, may be provided to allow for retentive engagement of the cover 48 with the body 12. The features 56 may be one or more of a friction fit, resilient elements, such as snap-lock elements, and/or cooperating elements (e.g., detents) which allow for releasable mounting of the cover 48 to the body 12.

The cover 48 is formed to be mounted onto the body 12 so that no portion of the cover contacts the first surface 20 and that no portion of the cover contacts the pane 14. In addition, the cover 48 may be formed to have no portion contact the second surface 24 with the cover 48 mounted onto the body 12. In this manner, an artist may leave paint both on the first surface 20 and the pane 14 which can be conveniently covered for storage, without any disruption thereof. The skirt 54 may be provided with sufficient height to locate the top 52 spaced from the tray portion 16 with the cover 48 mounted to the body 12. The sufficient height may be measured from a plane generally coplanar with the back portion 42 of the body 12 and outwardly past the tray portion 16 accounting for sufficient headspace to accommodate any paints disposed on the pane 14 and/or the first surface 20. Preferably, one or more ribs 58 may be provided with the cover 48 configured to limit the depth of insertion of the body 12 into the cover 48 with the cover 48 being mounted the body 12. The ribs 58 may be configured to interferingly engage with the tray portion 16 and/or the edge 18.

The first surface 20 and/or the second surface 24 may be magnetized to enhance attraction with a medium disposed thereon. In addition to paints, the artist's palette 10 may be used with other media, such as make-up.

What is claimed is:

1. An artist's palette comprising:

a body having a tray portion defining a first, generally flat surface;

a protruding first ridge running along an edge of said first surface; and, a pane removably mountable to said body, said pane being transparent or sufficiently translucent to permit visual color matching through said pane of a sample of prepared paint disposed on said pane with a reference sample disposed between said pane and said body, wherein said pane defines an outwardly directed face, said outwardly directed face being generally coplanar with said first surface, said first ridge being located between said first surface and said pane.

2. An artist's palette as in claim 1, wherein said body having a back portion located opposite said tray portion, one or more threaded apertures being provided in said back portion of said body.

3. An artist's palette as in claim 2, wherein said one or more threaded apertures are disposed in said body such that said artist's palette may be mounted to a free-standing support using said one or more threaded apertures with said first ridge being located gravitationally below said first surface.

4. An artist's palette as in claim 1 further comprising a first shelf extending outwardly from said body configured to support at least one paint brush in a horizontal position.

5. An artist's palette as in claim 1, wherein at least portions of said first surface are magnetized.

6. An artist's palette as in claim 1, wherein said pane includes at least one resilient locking member formed to releasably engage an aperture formed in said body.

7. An artist's palette as in claim 1, wherein said tray portion defining a second, generally flat surface, between said first ridge and said pane.

8. An artist's palette as in claim 7, wherein a protruding second ridge runs along an edge of said second surface opposite said first ridge.

9. An artist's palette as in claim 8, wherein said first and second ridges are generally parallel.

10. An artist's palette as in claim 8, wherein said first and second surfaces are generally coplanar.

11. An artist's palette as in claim 7, wherein said first and second surfaces are generally coplanar.

12. An assembly comprising:

an artist's palette having:

a body having a first, generally flat surface;

a protruding first ridge running along an edge of said first surface; and, a pane removably mountable to said body, said pane being transparent or sufficiently translucent to permit visual color matching through said pane of a sample of prepared paint disposed on said pane with a reference sample disposed between said pane and said body; and, a cover removably mountable to said body, said cover being configured to be mounted to said body without any portion of said cover contacting said first surface and without any portion of said cover contacting said pane, wherein said cover includes a skirt formed to telescope over said body and one or more ribs located interiorly of said skirt configured to limit the depth of insertion of said body into said cover with said cover being mounted to said body.

13. An assembly as in claim 12, wherein said artist's palette further comprising one or more threaded apertures in said body.

14. An assembly as in claim 13, wherein said one or more threaded apertures are disposed in said body such that said artist's palette may be mounted to a free-standing support using said one or more threaded apertures with said first ridge being located gravitationally below said first surface.

15. An assembly as in claim 12, wherein said pane defines an outwardly directed face, said outwardly directed face being generally coplanar with said first surface.

16. An assembly as in claim 12, wherein said artist's palette further comprising a first shelf extending outwardly from said body configured to support at least one paint brush in a horizontal position.

17. An assembly as in claim 12, wherein at least portions of said first surface are magnetized.

18. An assembly as in claim 12, wherein said pane includes at least one resilient locking member formed to releasably engage an aperture formed in said body.

* * * * *